US009067296B2

(12) United States Patent
Ono et al.

(10) Patent No.: US 9,067,296 B2
(45) Date of Patent: Jun. 30, 2015

(54) POLISHING METHOD

(75) Inventors: Katsutoshi Ono, Tokyo (JP); Yu Ishii, Tokyo (JP); Hisanori Matsuo, Tokyo (JP); Kuniaki Yamaguchi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 575 days.

(21) Appl. No.: 13/454,146

(22) Filed: Apr. 24, 2012

(65) Prior Publication Data

US 2012/0276816 A1 Nov. 1, 2012

(30) Foreign Application Priority Data

Apr. 28, 2011 (JP) ..... 2011-101051

(51) Int. Cl.

| | |
|---|---|
| ***B24B 37/015*** | (2012.01) |
| ***B24B 37/04*** | (2012.01) |
| ***B24B 37/10*** | (2012.01) |
| ***B24B 57/02*** | (2006.01) |

(52) U.S. Cl.

CPC ..... *B24B 37/015* (2013.01); *B24B 37/042* (2013.01); *B24B 37/105* (2013.01); *B24B 57/02* (2013.01)

(58) Field of Classification Search

CPC .. B24B 37/005; B24B 37/015; B24B 37/042; H01L 21/67248

See application file for complete search history.

(56) References Cited

U.S. PATENT DOCUMENTS

| | | | | |
|---|---|---|---|---|
| 3,738,882 | A * | 6/1973 | Basi | 438/692 |
| 3,775,201 | A * | 11/1973 | Basi | 438/692 |
| 5,775,980 | A * | 7/1998 | Sasaki et al. | 451/285 |
| 6,012,967 | A | 1/2000 | Satake et al. | |
| 6,077,783 | A * | 6/2000 | Allman et al. | 438/691 |
| 2005/0186891 | A1 * | 8/2005 | Benner | 451/56 |
| 2007/0135020 | A1 * | 6/2007 | Nabeya | 451/7 |
| 2009/0078583 | A1 * | 3/2009 | Kobata et al. | 205/641 |
| 2009/0170320 | A1 * | 7/2009 | Heinrich et al. | 438/692 |
| 2010/0248593 | A1 | 9/2010 | Sakai et al. | |
| 2011/0159782 | A1 * | 6/2011 | Sone et al. | 451/7 |
| 2012/0220196 | A1 * | 8/2012 | Maruyama et al. | 451/7 |

FOREIGN PATENT DOCUMENTS

| | | |
|---|---|---|
| JP | 10-094964 | 4/1998 |
| JP | 11-188612 | 7/1999 |
| JP | 2001-062706 | 3/2001 |
| JP | 2001-308040 | 11/2001 |
| JP | 2004-363270 | 12/2004 |
| JP | 2007-181910 | 7/2007 |

* cited by examiner

*Primary Examiner* — Lee D Wilson
*Assistant Examiner* — Tyrone V Hall, Jr.
(74) *Attorney, Agent, or Firm* — Wenderoth, Lind & Ponack, L.L.P.

(57) ABSTRACT

A polishing method for reducing an amount of polishing liquid used without lowering a polishing rate is provided. The polishing method comprises determining, in advance, the relationship between a supply flow rate of a polishing liquid and a polishing rate at the time the substrate is polished without controlling a surface temperature of the polishing pad, and the relationship between a supply flow rate of a polishing liquid and a polishing rate at the time the substrate is polished while controlling a surface temperature of the polishing pad at a predetermined level, and continuously supplying the polishing liquid to the surface of the polishing pad to achieve a higher polishing rate when the substrate is polished while controlling the surface temperature of the polishing pad at the predetermined level, than when the substrate is polished without controlling the surface temperature of the polishing pad.

12 Claims, 4 Drawing Sheets

POLISHING METHOD

CROSS REFERENCE TO RELATED APPLICATIONS

This document claims priority to Japanese Application Number 2011-101051, filed Apr. 28, 2011, the entire contents of which are hereby incorporated by reference.

BACKGROUND OF THE INVENTION

1. Field of the Invention

The present invention relates to a polishing method for polishing a surface to be polished of a substrate, such as a semiconductor wafer or the like, by pressing the surface to be polished of the substrate against a polishing surface of a polishing pad while supplying a polishing liquid (slurry) to the polishing surface, and moving the surface to be polished of the substrate and the polishing surface relative to each other.

2. Description of the Related Art

There have been known chemical mechanical polishing (CMP) apparatus which polish or planarize a surface to be polished of a substrate, such as a semiconductor wafer or the like, that is held by a polishing head. The CMP apparatus include a polishing pad applied to an upper surface of a polishing table and providing a polishing surface. The CMP apparatus operate by pressing the surface to be polished of the substrate against the polishing surface of the polishing pad, and rotating the polishing table and the polishing head to move the polishing surface and the surface to be polished of the substrate relative to each other while supplying a polishing liquid (slurry) to the polishing surface.

CMP technology requires that various conditions be satisfied to polish substrates at a maximum polishing rate, i.e., within a shortest period of polishing time, in order to maximize the number of substrates to be polished per unit time. To meet the requirements, CMP apparatus achieve a desired polishing rate by adjusting the pressure under which the substrate is pressed against the polishing surface of the polishing pad during polishing, the rotational speeds of the polishing head and the polishing table, and the flow rate at which the polishing liquid is supplied to the polishing surface of the polishing pad.

When a substrate is polished by such a CMP apparatus, on the other hand, heat is generated by the friction between the substrate and the polishing pad, resulting in an excessive increase in the temperature of the surface of the polishing pad and hence the temperature of a polishing interface between the polishing pad and the substrate. Such an excessive increase in the temperature may possibly prevent the CMP apparatus from achieving a maximum polishing rate. One solution is to eject a gas such as a cooling gas or the like from a gas ejecting portion such as a cooling nozzle or the like toward the surface of the polishing pad to mainly deprive the surface of the polishing pad of vaporization heat, thereby keeping normal the temperature of the surface of the polishing pad and hence the temperature of the polishing interface between the polishing pad and the substrate for a maximum polishing rate.

It has been proposed to control the surface temperature of the polishing pad in a temperature range below about 50° C., i.e., at 44° C., for thereby reducing dishing (see Japanese laid-open patent publication No. 2001-308040), and to measure the surface temperature of the polishing pad and cool the polishing pad with a cooling mechanism provided on the polishing pad, for example, depending on changes in the surface temperature of the polishing pad (see Japanese laid-open patent publication No. 2001-62706).

The applicant has proposed a polishing apparatus including a fluid ejecting mechanism for ejecting a gas, such as a compressed gas, toward the polishing surface. The fluid ejecting mechanism is controlled to maintain the polishing surface in a certain temperature distribution based on the measured temperature distribution of the polishing surface (see Japanese laid-open patent publication No. 2007-181910).

SUMMARY OF THE INVENTION

The polishing rate depends on the pressure under which the substrate is pressed against the polishing surface of the polishing pad during polishing, the rotational speeds of the polishing head and the polishing table, and the flow rate at which the polishing liquid is supplied to the polishing surface of the polishing pad. In order to keep the polishing rate at a certain level or higher, it has been considered to supply a sufficient amount of polishing liquid to the polishing surface of the polishing pad. Actually, it is generally known that the polishing rate is lowered if the amount of polishing liquid supplied to the polishing surface is reduced. This phenomenon has been thought to occur when the amount of abrasive grain, which contributes to the polishing process, is reduced.

However, it has been found that the polishing rate correlates more strongly with the surface temperature of the polishing pad than the amount of abrasive grain, and that the polishing rate is not lowered, or is kept high, by controlling the surface temperature of the polishing pad at a predetermined level even when the amount of a polishing liquid used is smaller than if the surface temperature of the polishing pad is not controlled.

The present invention has been made in view of the above situation. It is therefore an object of the present invention to provide a polishing method which makes it possible to reduce an amount of polishing liquid used without lowering a polishing rate.

In order to achieve the above object, the present invention provides a polishing method for polishing a substrate by keeping the substrate in sliding contact with a surface of a polishing pad while supplying a polishing liquid to the surface of the polishing pad, the method comprising: determining, in advance, the relationship between a supply flow rate of a polishing liquid and a polishing rate at the time the substrate is polished without controlling a surface temperature of the polishing pad, and the relationship between a supply flow rate of a polishing liquid and a polishing rate at the time the substrate is polished while controlling a surface temperature of the polishing pad at a predetermined level; and continuously supplying the polishing liquid to the surface of the polishing pad to achieve a higher polishing rate when the substrate is polished while controlling the surface temperature of the polishing pad at the predetermined level, than when the substrate is polished without controlling the surface temperature of the polishing pad.

Generally, when the amount of the polishing liquid used is reduced, the amount of abrasive grain that contributes to a polishing process is reduced, resulting in a reduction in the polishing rate. The polishing rate correlates more strongly with the surface temperature of the polishing pad than the amount of abrasive grain. It is thus possible to reduce the amount of the polishing liquid used without lowering the polishing rate by controlling the surface temperature of the polishing pad at the predetermined level.

The present invention also provides a polishing method for polishing a substrate by keeping the substrate in sliding contact with a surface of a polishing pad while supplying a polishing liquid to the surface of the polishing pad, the polishing method comprising: determining, in advance, the relationship between a supply flow rate of a polishing liquid and a polishing rate at the time the substrate is polished without controlling a surface temperature of the polishing pad, and while continuously supplying the surface of the polishing pad with the polishing liquid at a flow rate smaller than a flow rate for a maximum polishing rate, polishing the substrate while controlling a surface temperature of the polishing pad at a predetermined level.

In a preferred aspect of the present invention, the polishing liquid is continuously supplied to the surface of the polishing pad at a flow rate in a range equal to or higher than 20 ml/min and lower than 200 ml/min.

As the surface temperature of the polishing pad is controlled at the predetermined level, an appropriate polishing rate can be achieved even when the polishing liquid is continuously supplied to the surface of the polishing pad at a flow rate lower than 200 ml/min. It has been confirmed that the consumption of the polishing liquid can be made smaller than a case where the surface temperature of the polishing pad is not controlled. When the polishing liquid is continuously supplied to the surface of the polishing pad at a flow rate of 20 ml/min or higher, the polishing liquid can be supplied to the entire surface of the polishing pad thereby to avoid problems including (1) a reduction in the uniformity of the removal amount over the surface to be polished of the substrate, (2) an extreme reduction in the polishing rate due to a shortage of abrasive grain that contributes to the polishing process, and (3) an inhibition of a normal polishing process owing to partial dry areas on the surface of the polishing pad which are developed by the heat generated by the polishing process.

In a preferred aspect of the present invention, the polishing liquid is continuously supplied to the surface at of the polishing pad at a flow rate in a range from 50 ml/min to 180 ml/min.

For example, when an insulating film such as a thermally oxidized film or the like formed on the surface of the substrate is polished, it has been confirmed that an appropriate polishing rate can be achieved even when the polishing liquid is continuously supplied to the surface of the polishing pad at a flow rate in a range from 50 ml/min to 180 ml/min by controlling the surface temperature of the polishing pad in a range from, e.g., 42° C. to 46° C.

In a preferred aspect of the present invention, the polishing liquid is continuously supplied to the surface of the polishing pad at a flow rate in a range from 50 ml/min to 175 ml/min.

For example, when a copper film formed on the surface of the substrate is polished, it has been confirmed that an appropriate polishing rate can be achieved even when the polishing liquid is continuously supplied to the surface of the polishing pad at a flow rate in a range from 50 ml/min to 175 ml/min by controlling the surface temperature of the polishing pad at e.g., 50° C.

In a preferred aspect of the present invention, the polishing liquid is a polishing slurry containing additives, with ceria used as abrasive grain.

The polishing slurry, which contains additives with ceria (cerium oxide: $CeO_2$) used as abrasive grain and performing a chemical-mechanical polishing action, is effective to achieve a high polishing rate.

In a preferred aspect of the present invention, the surface temperature of the polishing pad is controlled by at least one of (1) a process of applying compressed air to the polishing pad, (2) a process of bringing a device having a coolant passage defined therein for passing a cooling therethrough into contact with the polishing pad, (3) a process of applying a mist to the polishing pad, and (4) a process of applying a cooling gas to the polishing pad.

According to the present invention, an amount of the polishing liquid used can be reduced to a level smaller than a case where the surface temperature of the polishing pad is not controlled, without lowering the polishing rate by controlling the surface temperature of the polishing pad at a predetermined level while continuously supplying the polishing liquid to the surface of the polishing pad.

DETAILED DESCRIPTION OF THE PREFERRED EMBODIMENTS

Preferred embodiments of the present invention will now be described with reference to the drawings.

Figure 1:
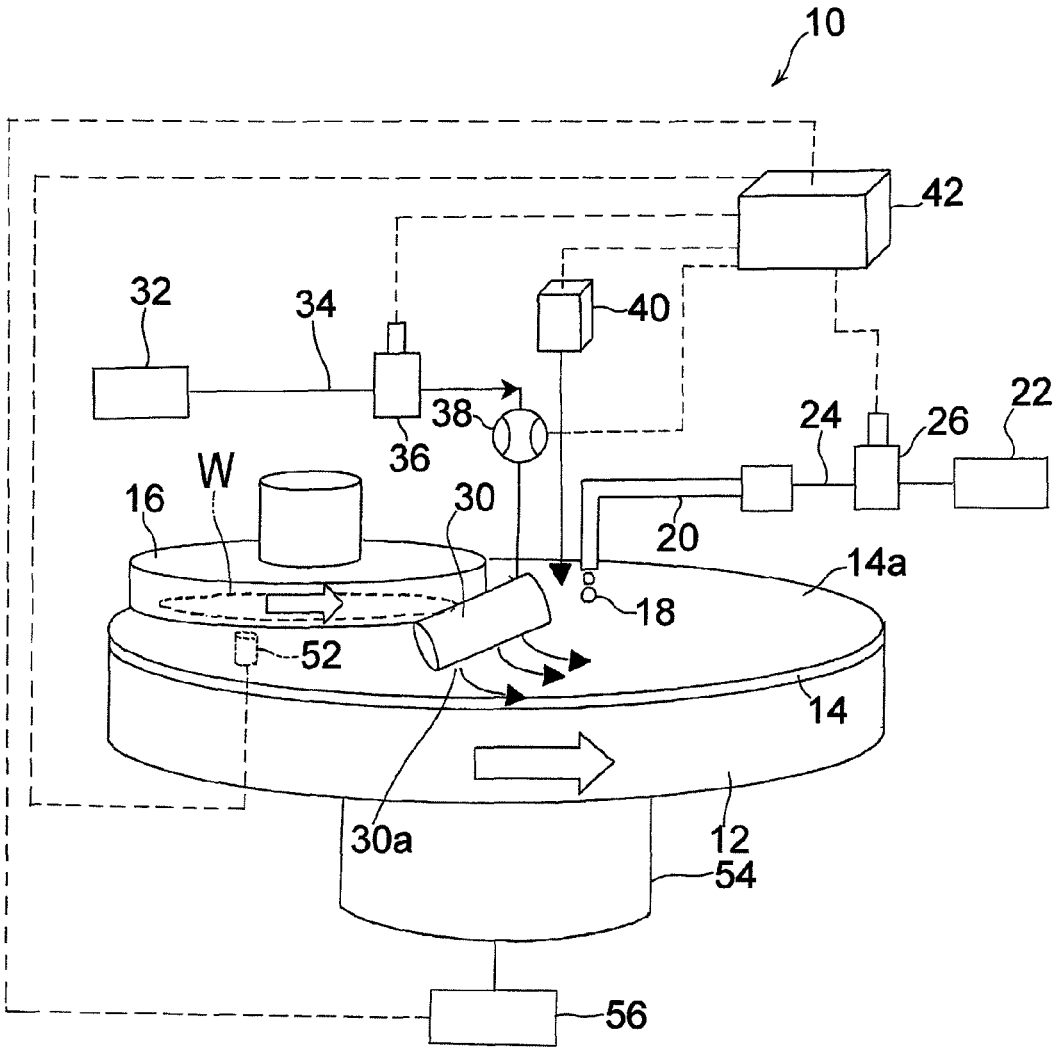
FIG. 1 is a schematic perspective view of a polishing apparatus which is used to carry out a polishing method according to the present invention.

FIG. 1 schematically shows in perspective a polishing apparatus 10 which is used to carry out a polishing method according to the present invention. As shown in FIG. 1, the polishing apparatus 10 includes a rotatable polishing table 12, a polishing pad 14 applied to an upper surface of the polishing table 12 and having an upper polishing surface **14*a*, a rotatable polishing head 16 for holding a substrate W, such as a semiconductor wafer or the like, on its lower surface and pressing the substrate W against the polishing surface 14*a*, and a polishing liquid supply nozzle 20, disposed above the polishing pad 14, for supplying a polishing liquid 18 to the polishing surface 14*a*. The polishing liquid supply nozzle 20 is connected to a polishing liquid supply line 24 extending from a polishing liquid supply source 22. The polishing liquid supply line 24 includes a flow rate control valve 26 whose opening can be adjusted for controlling the rate at which the polishing liquid 18 flows from the polishing liquid supply source 22 to the polishing liquid supply nozzle 20**.

For polishing an insulating film such as a thermally oxidized film or the like, the polishing liquid 18 is in the form of a polishing slurry containing additives, with ceria (cerium oxide: $CeO_2$) used as abrasive grain, for example. As ceria, which is used as abrasive grain in the polishing slurry used as the polishing liquid 18, performs a chemical mechanical polishing action, the polishing slurry achieves a high polishing rate for a thermally oxidized film or the like. For polishing a copper film, the polishing liquid 18 is in the form of a polishing slurry for polishing copper.

When the surface to be polished of the substrate W held on the lower surface of the polishing head 16 which is rotating is pressed against the polishing surface 14*a* of the polishing pad 14 on the polishing table 12 which is rotating, and the polishing slurry as the polishing liquid 18 is supplied from the polishing liquid supply nozzle 20 to the polishing surface 14*a* of the polishing pad 14, the surface to be polished of the substrate W is polished upon relative movement of the substrate W and the polishing surface 14*a*. While the surface to be polished of the substrate W is being thus polished, the opening of the flow rate control valve 26 is adjusted to control the flow rate of the polishing liquid 18 to be supplied to the polishing surface 14*a* of the polishing pad 14.

In this embodiment, the polishing pad 14 is made of a material having its modulus of elasticity variable in the range from 10 GPa to 10 MPa within a temperature range from 0° C. to 80° C. For example, the polishing pad made of a resin becomes harder when cooled for eliminating steps on the surface to be polished of the substrate W. The polishing head 16 is vertically movable and is connected to a free end of a swing arm, not shown, so that the polishing head 16 is horizontally movable between a polishing position above the polishing table 12 and a substrate transfer position on a pusher or the like of a linear transporter, not shown, for example.

A cooling nozzle 30, as a gas ejection section, is disposed above the polishing pad 14 and extends parallel to the polishing surface 14*a* of the polishing pad 14 substantially radially thereacross. The cooling nozzle (gas ejection section) 30 has gas ejecting ports 30*a* defined in a lower wall thereof and held in fluid communication with an inner passage in the cooling nozzle 30. The gas ejecting ports 30*a* ejects a cooling gas such as compressed air or the like supplied from the inner passage toward the polishing surface 14*a* of the polishing pad 14. The position of the cooling nozzle 30 with respect to the polishing pad 14 and the number of the gas ejecting ports 30*a* are selected as desired depending on polishing process conditions.

In this embodiment, the cooling nozzle 30 is used as a gas ejection section for ejecting a cooling gas such as compressed air or the like toward the polishing surface 14*a* of the polishing pad 14. However, a gas ejection section for ejecting a gas such as temperature-controlled air for adjusting the temperature of the polishing pad 14 to a desired temperature, or a mist ejection section for ejecting a temperature-controlled mist may be used instead of the cooling nozzle 30. Alternatively, a device having a coolant passage therein may be used as a temperature adjusting slider instead of the cooling nozzle 30 for movement into and out of contact with the polishing pad 14 and/or the polishing table 12. This device (temperature adjusting slider) may be brought into and out of contact with the polishing pad 14 and/or the polishing table 12 to cool the polishing pad 14.

The cooling nozzle 30 is connected to a gas supply line 34 extending from a gas supply source 32. The gas supply line 34 includes a pressure control valve 36 and a flow rate meter 38 that are successively disposed along the direction in which the cooling gas flows from the gas supply source 32 to the cooling nozzle 30. The cooling gas (compressed air) that is supplied from the gas supply source 32 has its pressure controlled by the pressure control valve 36. The cooling gas under the controlled pressure flows from the pressure control valve 36 into the flow rate meter 38, which measures the flow rate at which the cooling gas flows. Then, the cooling gas flows into the cooling nozzle 30 and is ejected from the gas ejecting ports 30*a* toward the polishing pad 14. The pressure control valve 36 operates to control the flow rate at which the cooling gas is ejected from the gas ejecting ports 30*a* toward the polishing pad 14.

A thermometer 40 such as a radiation thermometer, for example, for detecting the surface temperature of the polishing pad 14 is disposed above the polishing pad 14. The thermometer 40 is electrically connected to a controller 42 which sets, e.g., a target temperature for the surface of the polishing pad 14. The controller 42 is also electrically connected to the pressure control valve 36. The pressure control valve 36 is controlled according to a PID control process by a control signal from the controller 42.

Specifically, the controller 42 stores a plurality of PID parameters. Depending on a difference between the target surface temperature of the polishing pad 14 set in the controller 42 and the actual surface temperature of the polishing pad 14 detected by the thermometer 40, the controller 42 selects at least one of the stored PID parameters and controls the opening of the pressure control valve 36 through an electropneumatic regulator, not shown, according to the selected PID parameter to achieve the target surface temperature of the polishing pad 14 based on temperature of the polishing pad 14 detected by the thermometer 40. The controller 42 controls the opening of the pressure control valve 36 such that the cooling gas (compressed air) is ejected from the gas ejecting ports 30*a* toward the polishing pad 14 at a flow rate in the range from 50 to 1000 ml/min, for example. The flow rate meter 38 and the flow rate control valve 26 are also electrically connected to the controller 42. The opening of the flow rate control valve 26 is controlled by a control signal from the controller 42.

The polishing table 12 incorporates an embedded eddy-current sensor 52 for measuring in real time a thickness of a metal film or an insulating thin film to be polished formed on the surface of the substrate W. The polishing table 12 can be rotated by a table motor 54 that is electrically connected to a table current monitor 56 that monitors a table current that is supplied to the table motor 54. Output signals from the eddy-current sensor 52 and the table current monitor 56 are supplied to the controller 42, which measures the polishing rate in real time.

Specifically, the controller 42 determines in real time the polishing rate based on the relationship between the thickness of the film measured by the eddy-current sensor 52 and time. A frictional force that is generated when the substrate W is polished by the polishing surface 14*a* is proportional to the polishing rate, and the table current is also proportional to the polishing rate. Therefore, if these relationships are determined in advance and stored as data in the controller 42, the controller 42 can measure the polishing rate in real time based on the stored data by monitoring the table current supplied to the table motor 54 with the table current monitor 56.

An optical sensor may be used instead of the eddy-current sensor 52 for measuring the thickness of the film. The eddy-current sensor 52 and the table current monitor 56 may be alternatively used, i.e., either one of them may be provided and connected to the controller 42.

The controller 42 stores therein data that have been experimentally determined. The stored data include the relationship between the flow rate at which the polishing liquid is supplied and the polishing rate at the time the substrate W is polished without controlling the surface temperature of the polishing pad 14, the relationship between the flow rate at which the polishing liquid is supplied and the polishing rate at the time the substrate W is polished while controlling the surface temperature of the polishing pad 14 at a predetermined level, etc.

Figure 2:
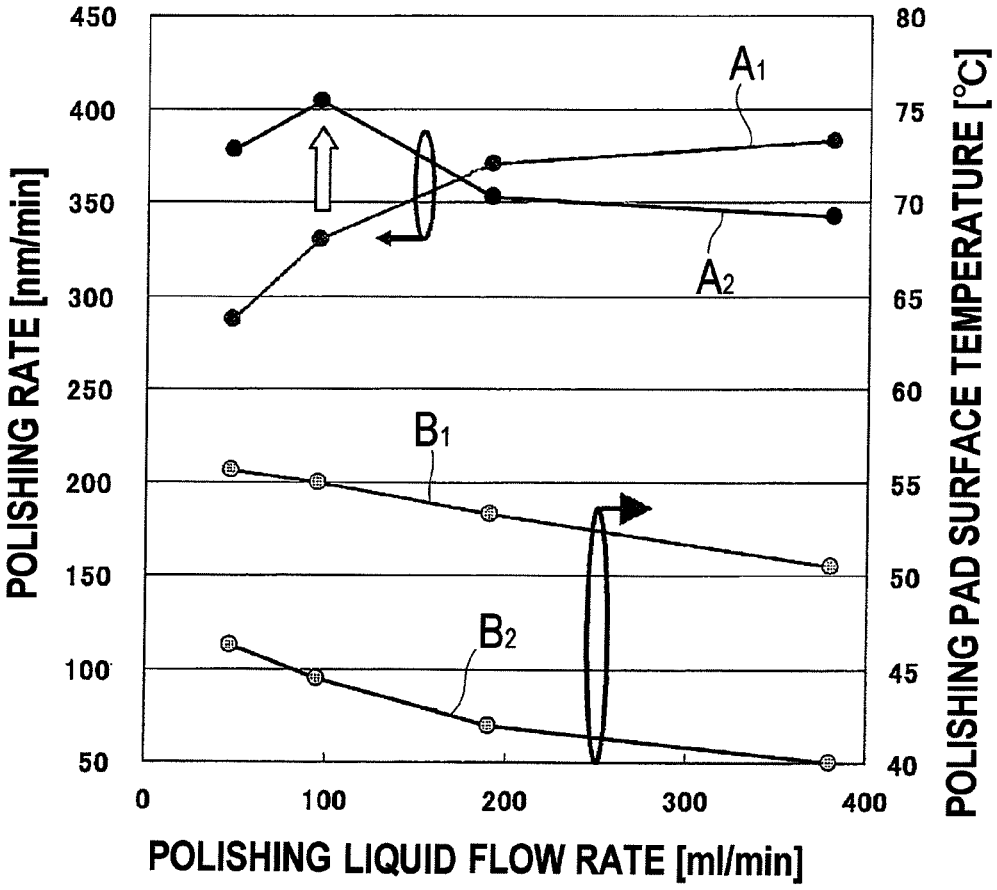
FIG. 2 is a graph showing the relationship between the polishing rate and the flow rate of a polishing liquid and the relationship between the surface temperature of a polishing pad and the flow rate of a polishing liquid at the time a thermally oxidized film was polished without controlling the surface temperature of the polishing pad, and also showing the relationship between the polishing rate and the flow rate of a polishing liquid and the relationship between the surface temperature of a polishing pad and the flow rate of a polishing liquid at the time a thermally oxidized film was polished while controlling the surface temperature of the polishing pad.

FIG. 2 shows data obtained when a polishing slurry containing additives, with ceria used as abrasive grain, was used as the polishing liquid 18, the polishing table 12 and the polishing head 16 were rotated respectively at 100 rpm and 107 rpm, and the substrate W held by the polishing head 16 was pressed against the polishing surface 14*a* of the polishing pad 14 under a polishing pressure of 0.35 kgf/cm$^2$ (5 psi) to polish a thermally oxidized film formed fully on the surface of the substrate W for 60 seconds. The polishing pad 14 was in the form of a single layer of hard foamed polyurethane IC-1000 manufactured by Rodel Inc.

In FIG. 2, a curve $A_1$ represents the relationship between the polishing rate and the flow rate of the polishing liquid 18 at the time a thermally oxidized film was polished without controlling the surface temperature of the polishing pad 14, and a curve $B_1$ represents the relationship between the surface temperature of the polishing pad 14 and the flow rate of the polishing liquid 18 at the time a thermally oxidized film was polished without controlling the surface temperature of the polishing pad 14. A curve $A_2$ represents the relationship between the polishing rate and the flow rate of the polishing liquid 18 at the time a thermally oxidized film was polished while controlling the surface temperature of the polishing pad 14 at a predetermined level, and a curve $B_2$ represents the relationship between the surface temperature of the polishing pad 14 and the flow rate of the polishing liquid 18 at the time a thermally oxidized film was polished while controlling the surface temperature of the polishing pad 14 at a predetermined level.

It can be seen from the curve $A_1$ shown in FIG. 2 that when the thermally oxidized film is polished without controlling the surface temperature of the polishing pad 14, a high polishing rate in the range from about 370 nm/min to about 380 nm/min is achieved if the flow rate of the polishing liquid is 200 ml/min or higher. Heretofore, when a thermally oxidized film is polished under the above conditions, it has been customary to supply the polishing liquid at a flow rate in the range from 200 ml/min to 300 ml/min to the polishing surface 14*a* of the polishing pad 14 for achieving a high polishing rate. It will be understood from the curve $B_1$ shown in FIG. 2 that the surface temperature of the polishing pad 14 is in the range from about 51° C. to 54° C. when the polishing liquid is supplied at a flow rate in the range from 200 ml/min to 300 ml/min to the polishing surface 14*a* of the polishing pad 14.

On the other hand, it can be seen from the curves $A_2$, $B_2$ shown in FIG. 2 that when the thermally oxidized film is polished while controlling the surface temperature of the polishing pad 14 at about 45° C., a high polishing rate of about 400 nm/min is achieved if the flow rate of the polishing liquid is 100 ml/min. It can thus be understood that when the thermally oxidized film is polished while controlling the surface temperature of the polishing pad 14 at about 45° C., it is possible to achieve a higher polishing rate even if the flow rate of the polishing liquid is reduced from 200 ml/min or higher to 100 ml/min, for example, than a when the thermally oxidized film is polished with the polishing liquid being supplied at a flow rate of 200 ml/min or higher without controlling the surface temperature of the polishing pad 14.

Similarly, it can be seen that when the thermally oxidized film is polished while controlling the surface temperature of the polishing pad 14 at about 46° C., a high polishing rate of about 370 nm/min is achieved if the flow rate of the polishing liquid is 50 ml/min. It can thus be understood that when the thermally oxidized film is polished while controlling the surface temperature of the polishing pad 14 at about 46° C., it is possible to achieve the same polishing rate even if the flow rate of the polishing liquid is reduced from 200 ml/min or higher to 50 ml/min, for example, as when the thermally oxidized film is polished with the polishing liquid being supplied at a flow rate of 200 ml/min or higher without controlling the surface temperature of the polishing pad 14.

The curves $A_1$, $A_2$ cross each other when the polishing liquid is supplied at a flow rate of 180 ml/min. At lower flow rates than the flow rate of 180 ml/min, the polishing rate is higher when the thermally oxidized film is polished while controlling the surface temperature of the polishing pad 14 at a predetermined level than when the thermally oxidized film is polished without controlling the surface temperature of the polishing pad 14. When the thermally oxidized film is polished with the polishing liquid being supplied at a flow rate lower than about 200 ml/min while controlling the surface temperature of the polishing pad 14 at a predetermined level, it is possible to achieve substantially the same polishing rate as when the thermally oxidized film is polished with the polishing liquid being supplied at a flow rate of 200 ml/min or higher without controlling the surface temperature of the polishing pad 14. It can thus be understood that when the thermally oxidized film is polished while controlling the surface temperature of the polishing pad 14 at a predetermined level, it is possible to prevent the polishing rate from being lowered with the polishing liquid being supplied at a reduced flow rate, by supplying the polishing liquid at a flow rate lower than about 200 ml/min, particularly about 180 ml/min or lower. The surface temperature of the polishing pad 14 at this time is about 42° C. as indicated by the curve $B_2$ shown in FIG. 2.

If a surface of a polishing pad is supplied with the polishing liquid at a flow rate of 20 ml/min or lower, then the surface of the polishing pad is not fully covered with the polishing liquid, resulting in various problems including (1) a reduction in the uniformity of the removal amount over the surface to be polished of the substrate, (2) an extreme reduction in the polishing rate due to a shortage of abrasive grain that contributes to the polishing process, and (3) an inhibition of a normal polishing process owing to partial dry areas on the surface of the polishing pad which are developed by the heat generated by the polishing process.

As described hereinabove, when the thermally oxidized film is polished, the consumption of the polishing liquid 18 is reduced without causing a reduction in the polishing rate by controlling the flow rate of the polishing liquid 18 that is continuously supplied to the polishing surface 14*a* of the polishing pad 14 at a flow rate in a range equal to or higher than 20 ml/min and lower than 200 ml/min, preferably in the range from 50 ml/min to 180 ml/min by controlling the surface temperature of the polishing pad 14 at a predetermined level. When the flow rate of the polishing liquid 18 that is continuously supplied to the polishing surface 14*a* of the polishing pad 14 is controlled at a flow rate equal to or higher than 20 ml/min and lower than 200 ml/min, preferably in the range from 50 ml/min to 180 ml/min, the surface temperature of the polishing pad 14 is in the range from about 42° C. to about 46° C. as indicated by the curve $B_2$ shown in FIG. 2.

The flow rate of the polishing liquid 18 that is continuously supplied to the polishing surface 14*a* of the polishing pad 14 is controlled at a constant flow rate regardless of the elapse of the polishing time.

Figure 3:
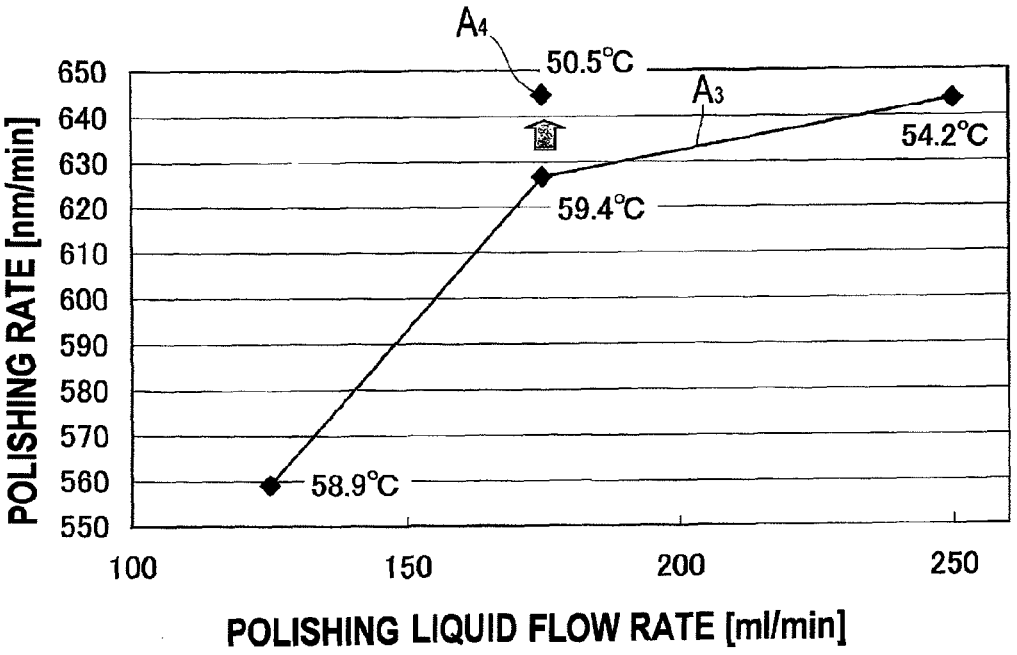
FIG. 3 is a graph showing the relationship between the polishing rate and the flow rate of a polishing liquid at the time a copper film was polished without controlling the surface temperature of the polishing pad, and also showing the relationship between the polishing rate and the flow rate of a polishing liquid at the time a copper film was polished while controlling the surface temperature of the polishing pad at about 50° C.
Figure 4:
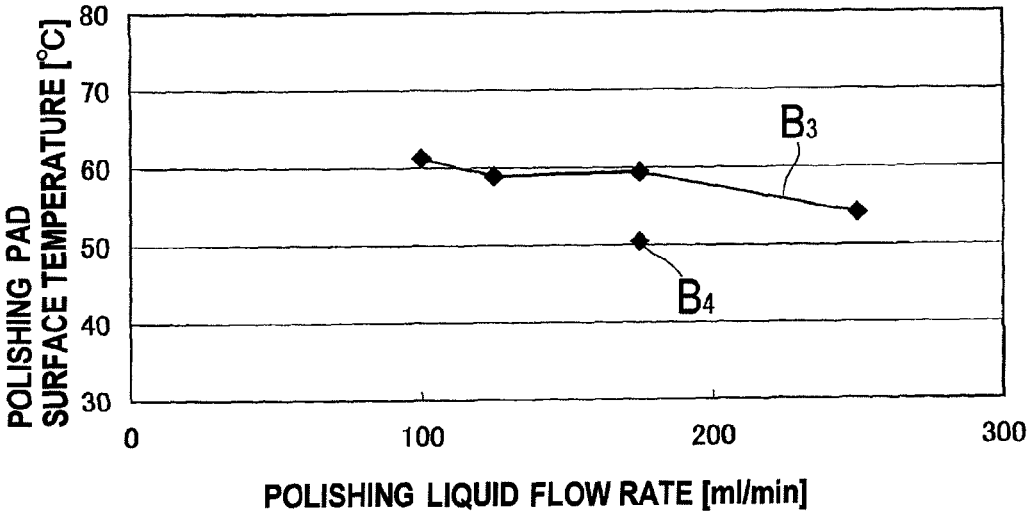
FIG. 4 is a graph showing the relationship between the surface temperature of a polishing pad and the flow rate of a polishing liquid at the time a copper film was polished without controlling the surface temperature of the polishing pad, and also showing the relationship between the surface temperature of a polishing pad and the flow rate of a polishing liquid at the time a copper film was polished while controlling the surface temperature of the polishing pad at about 50° C.

FIGS. 3 and 4 show data obtained when a polishing slurry for polishing copper was used as the polishing liquid 18, the polishing table 12 and the polishing head 16 were rotated respectively at 60 rpm and 31 rpm, and the substrate W held by the polishing head 16 was pressed against the polishing surface 14*a* of the polishing pad 14 under a polishing pressure of 0.21 kgf/cm$^2$ (3 psi) to polish a copper film formed on the surface of the substrate W for 60 seconds. The polishing pad 14 was in the form of a single layer of hard foamed polyurethane IC-1000 manufactured by Rodel Inc.

In FIG. 3, a curve $A_3$ represents the relationship between the polishing rate and the flow rate of the polishing liquid 18 at the time a copper film was polished without controlling the surface temperature of the polishing pad 14, and a point $A_4$ represents the relationship between the polishing rate and the flow rate of the polishing liquid 18 at the time a copper film was polished while controlling the surface temperature of the polishing pad 14 at about 50° C. In FIG. 4, a curve $B_3$ represents the relationship between the surface temperature of the polishing pad 14 and the flow rate of the polishing liquid 18 at the time a copper film was polished without controlling the surface temperature of the polishing pad 14, and a point $B_4$ represents the relationship between the surface temperature of the polishing pad 14 and the flow rate of the polishing liquid 18 at the time a copper film was polished while controlling the surface temperature of the polishing pad 14 at about 50° C.

It can be seen from the curve $A_3$ shown in FIG. 3 that when the copper film is polished without controlling the surface temperature of the polishing pad 14, a polishing rate of about 626 nm/min is achieved if the flow rate of the polishing liquid 18 is 175 ml/min, and a high polishing rate of about 644 nm/min is achieved if the flow rate of the polishing liquid 18 is 250 ml/min. Heretofore, when a copper film is polished under the above conditions, it has been customary to supply the polishing liquid at a flow rate in the range from 200 ml/min to 300 ml/min to the polishing surface 14*a* of the polishing pad 14 for achieving a high polishing rate. It will be understood from the curve $B_3$ shown in FIG. 4 that the surface temperature of the polishing pad 14 is in the range from about 59° C. to 54° C. when the polishing liquid is supplied at a flow rate in the range from 200 ml/min to 300 ml/min to the polishing surface 14*a* of the polishing pad 14.

On the other hand, it can be seen from the point $A_4$ shown in FIG. 3 and the point $B_4$ shown in FIG. 4 that when the copper film is polished while controlling the surface temperature of the polishing pad 14 at about 50° C., a polishing rate of about 645 nm/min is achieved if the flow rate of the polishing liquid is 175 ml/min. It can thus be understood that when the copper film is polished while controlling the surface temperature of the polishing pad 14 at about 50° C., it is possible to achieve substantially the same polishing rate even if the flow rate of the polishing liquid is reduced from 200 ml/min or higher to 175 ml/min, for example, as when the copper film is polished with the polishing liquid being supplied at a flow rate of 200 ml/min or higher without controlling the surface temperature of the polishing pad 14.

The above process of polishing the copper film is thought to exhibit essentially the same behavior as the above process of polishing the thermally oxidized film. Consequently, it is considered that when the copper film is polished, the consumption of the polishing liquid 18 is reduced without causing a reduction in the polishing rate by controlling the flow rate of the polishing liquid 18 that is supplied to the polishing surface 14*a* of the polishing pad 14 at a flow rate in the range from 50 ml/min to 175 ml/min while controlling the surface temperature of the polishing pad 14 at a predetermined level.

The flow rate of the polishing liquid 18 that is continuously supplied to the polishing surface 14*a* of the polishing pad 14 is controlled at a constant flow rate regardless of the elapse of the polishing time.

A polishing method for polishing a thermally oxidized film formed on the surface of the substrate W on the polishing apparatus 10 shown in FIG. 1 will be described below.

Based on the data shown in FIG. 2, a polishing slurry containing additives, with ceria used as abrasive grain, is used as the polishing liquid 18. The polishing table 12 and the polishing head 16 are rotated respectively at 100 rpm and 107 rpm, while at the same time the substrate W held by the polishing head 16 is pressed against the polishing surface 14*a* of the polishing pad 14 under a polishing pressure of 0.35 kgf/cm$^2$ (5 psi) to polish the thermally oxidized film formed on the surface of the substrate W.

When the thermally oxidized film is polished, the surface temperature of the polishing pad 14 is controlled at about 45° C., for example, according to a PID control process, while at the same time the polishing surface 14*a* of the polishing pad 14 is continuously supplied with the polishing liquid at a flow rate of 100 ml/min. The flow rate of the polishing liquid is controlled at the constant rate of 100 ml/min regardless of the elapse of the time.

Even if the consumption of the polishing liquid, i.e., the flow rate at which the polishing liquid is supplied, is reduced from 200 ml/min or higher to 100 ml/min, for example, it is possible to achieve a higher polishing rate for an increased throughput than when the thermally oxidized film is polished with the polishing liquid being supplied at a flow rate of 200 ml/min or higher under the same conditions using the same polishing liquid, without controlling the surface temperature of the polishing pad 14.

When the thermally oxidized film is polished, based on the data shown in FIG. 2, the polishing surface 14*a* may be supplied with the polishing liquid at a flow rate of 50 ml/min while controlling the surface temperature of the polishing pad 14 at about 46° C., for example, according to a PID control process. In this manner, it is possible to achieve essentially the same high polishing rate as when the thermally oxidized film is polished with the polishing liquid being supplied at a flow rate of 200 ml/min or higher under the same conditions using the same polishing liquid, without controlling the surface temperature of the polishing pad 14.

A polishing method for polishing a copper film formed on the surface of the substrate W on the polishing apparatus 10 shown in FIG. 1 will be described below.

Based on the data shown in FIGS. 3 and 4, a polishing slurry for polishing copper is used as the polishing liquid 18. The polishing table 12 and the polishing head 16 are rotated respectively at 60 rpm and 31 rpm, while at the same time the substrate W held by the polishing head 16 is pressed against the polishing surface 14*a* of the polishing pad 14 under a polishing pressure of 0.21 kgf/cm$^2$ (3 psi) to polish the copper film formed on the surface of the substrate W.

When the copper film is polished, the surface temperature of the polishing pad 14 is controlled at 50° C., for example, according to a PID control process, while at the same time the polishing surface 14*a* of the polishing pad 14 is supplied with the polishing liquid at a flow rate of 175 ml/min.

Even if the consumption of the polishing liquid, i.e., the flow rate at which the polishing liquid is supplied, is reduced from 200 ml/min or higher to 175 ml/min, for example, it is possible to achieve essentially the same high polishing rate as when the copper film is polished with the polishing liquid being supplied at a flow rate of 200 ml/min or higher under the same conditions using the same polishing liquid, without controlling the surface temperature of the polishing pad 14.

Although certain preferred embodiments of the present invention have been shown and described in detail, it should be understood that various changes and modifications may be made therein without departing from the scope of the appended claims.

What is claimed is:

1. A polishing method for polishing a substrate by keeping the substrate in sliding contact with a surface of a polishing pad while supplying a polishing liquid to the surface of the polishing pad, the polishing method comprising:

determining, in advance, a first relationship between a supply flow rate of a polishing liquid and a polishing rate when a substrate is polished without controlling a surface temperature of the polishing pad, a second relationship between a supply flow rate of a polishing liquid and a polishing rate when a substrate is polished while controlling a surface temperature of the polishing pad, and a third relationship between a surface temperature of the polishing pad and a supply flow rate of the polishing liquid when a substrate is polished while controlling the surface temperature of the polishing pad;

determining from the first relationship and the second relationship a flow rate range of the polishing liquid in which the polishing rate when the substrate is polished while controlling the surface temperature of the polishing pad is higher than the polishing rate when the substrate is polished without controlling the surface temperature of the polishing pad;

determining from the third relationship a temperature range of the surface temperature of the polishing pad corresponding to the determined flow rate range; and placing a substrate in sliding contact with the surface of the polishing pad, while continuously supplying the polishing liquid to the surface of the polishing pad at a flow rate within the determined flow rate range and while controlling the surface temperature of the polishing pad to be within the determined temperature range.

2. A polishing method according to claim 1, wherein the determined flow rate range is equal to or higher than 20 ml/min and lower than 200 ml/min.

3. A polishing method according to claim 1, wherein the determined flow rate range is from 50 ml/min to 180 ml/min.

4. A polishing method according to claim 1, wherein the determined flow rate range is from 50 ml/min to 175 ml/min.

5. A polishing method according to claim 1, wherein the polishing liquid is a polishing slurry containing additives, with ceria used as abrasive grain.

6. A polishing method according to claim 1, wherein the controlling of the surface temperature of the polishing pad comprises at least one of (1) applying compressed air to the polishing pad, (2) bringing a device having a coolant passage defined therein for passing a coolant therethrough into contact with the polishing pad, (3) applying a mist to the polishing pad, and (4) applying a cooling gas to the polishing pad.

7. A polishing method for polishing a substrate by keeping the substrate in sliding contact with a surface of a polishing pad while supplying a polishing liquid to the surface of the polishing pad, the polishing method comprising:

determining, in advance, a first relationship between a supply flow rate of a polishing liquid and a polishing rate when a substrate is polished without controlling a surface temperature of the polishing pad, a second relationship between a supply flow rate of a polishing liquid and a polishing rate when a substrate is polished while controlling a surface temperature of the polishing pad, and a third relationship between a surface temperature of the polishing pad and a supply flow rate of the polishing liquid when a substrate is polished while controlling the surface temperature of the polishing pad;

determining a flow rate range of the polishing liquid in which the polishing rate when the substrate is polished while controlling the surface temperature of the polishing pad is higher than the polishing rate when the substrate is polished without controlling the surface temperature of the polishing pad from the first relationship and the second relationship;

determining a temperature range of the surface temperature of the polishing pad corresponding to the determined flow rate range from the third relationship; and while continuously supplying the surface of the polishing pad with the polishing liquid at a flow rate smaller than a flow rate for a maximum polishing rate within the determined flow rate range, polishing a substrate while controlling the surface temperature of the polishing pad to be within the determined temperature range.

8. A polishing method according to claim 7, wherein the determined flow rate range is equal to or higher than 20 ml/min and lower than 200 ml/min.

9. A polishing method according to claim 7, wherein the determined flow rate range is from 50 ml/min to 180 ml/min.

10. A polishing method according to claim 7, wherein the determined flow rate range is from 50 ml/min to 175 ml/min.

11. A polishing method according to claim 7, wherein the polishing liquid is a polishing slurry containing additives, with ceria used as abrasive grain.

12. A polishing method according to claim 7, wherein the controlling of the surface temperature of the polishing pad comprises at least one of (1) applying compressed air to the polishing pad, (2) bringing a device having a coolant passage defined therein for passing a coolant therethrough into contact with the polishing pad, (3) applying a mist to the polishing pad, and (4) applying a cooling gas to the polishing pad.

* * * * *